United States Patent [19]

Berruex

[11] Patent Number: 4,936,921

[45] Date of Patent: Jun. 26, 1990

[54] METHOD AND APPARATUS FOR RINSING HYDROPHILIC SURFACES WITH A NON-AQUEOUS LIQUID

[76] Inventor: Serge Berruex, La Levratte 4, 1260 Nyon, Switzerland

[21] Appl. No.: 223,679

[22] Filed: Jul. 22, 1988

Related U.S. Application Data

[63] Continuation of Ser. No. 57,204, May 11, 1987, abandoned.

[30] Foreign Application Priority Data

Sep. 13, 1985 [CH] Switzerland ..... 3984/85
Sep. 11, 1986 [WO] PCT Int'l Appl. ..... PCT/CH86/00130

[51] Int. Cl.[5] ..... B08B 3/12
[52] U.S. Cl. ..... 134/1; 134/42
[58] Field of Search ..... 134/42, 1

[56] References Cited

U.S. PATENT DOCUMENTS

| | | | |
|---|---|---|---|
| 1,533,711 | 4/1925 | Stevens | 134/1 |
| 3,397,150 | 8/1968 | Burt et al. | 134/1 |
| 3,710,450 | 1/1973 | Figiel | 134/42 |
| 3,875,046 | 4/1975 | Rosenbloom | 208/391 |
| 3,935,076 | 1/1976 | Cymbalisty | 208/391 |
| 3,957,672 | 5/1976 | Zisman et al. | 134/42 |
| 4,035,282 | 7/1977 | Stuchberry et al. | 208/391 |
| 4,169,807 | 10/1979 | Zuber | 134/1 |

FOREIGN PATENT DOCUMENTS

| | | | |
|---|---|---|---|
| 0090677 | 10/1983 | European Pat. Off. . | |
| 2217045 | 2/1924 | France . | |
| 2213788 | 1/1973 | France . | |
| 2361479 | 3/1978 | France . | |
| 0499075 | 12/1970 | Switzerland . | |
| 718318 | 11/1954 | United Kingdom | 549/428 |
| 2104104 | 3/1983 | United Kingdom . | |

*Primary Examiner*—Asok Pal

[57] ABSTRACT

Surfaces wet with an aqueous liquid are treated by using a thermally stable and chemically inert non-solvent liquid so as to form an emulsion with the aqueous liquid to be removed from said surfaces up to the complete elimination of said aqueous liquid, whereafter the wet surfaces are subjected to a rinsing operation in the presence of vapors from said non-solvent liquid, and to drying. The installation for implementing such method comprises a first rinsing zone (1) wherein are arranged means (2,3) for the treatment of the surfaces by means of an inert non-solvent liquid intended to form an emulsion with the aqueous liquid to be eliminated from said surfaces, as well as means (16-18) for vaporizing the inert non-solvent liquid in a second rinsing zone (15), and a drying zone (20) situated preferably directly above said second vapor rinsing zone.

21 Claims, 1 Drawing Sheet

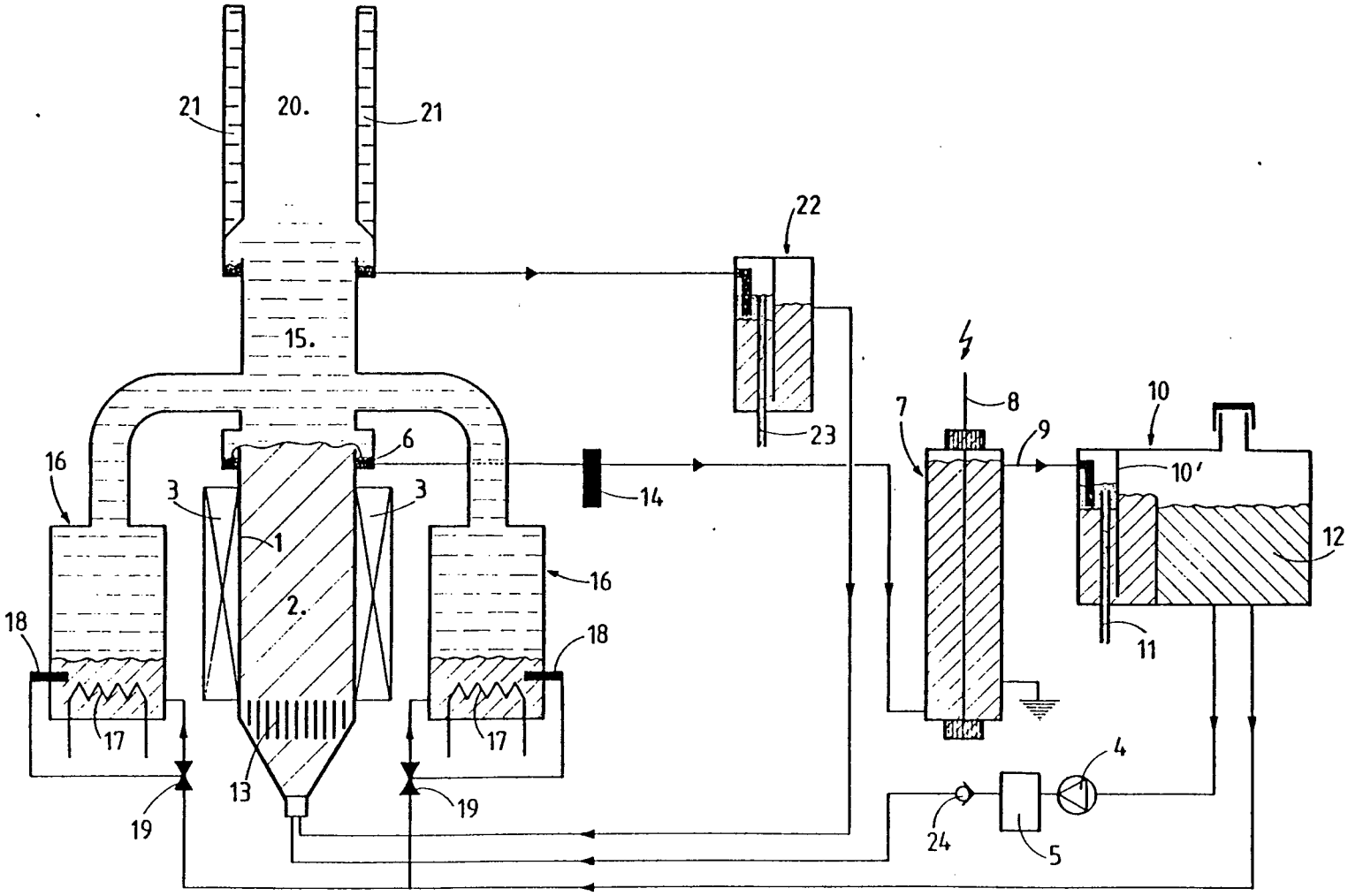
12
10'
10
11
4
5
9
8
24
7
22
23
14
16
18
17
19
21
6
3
20.
15.
2.
1
13

METHOD AND APPARATUS FOR RINSING HYDROPHILIC SURFACES WITH A NON-AQUEOUS LIQUID

This application is a continuation of application Ser. No. 057,204, filed May 11, 1987, now abandoned.

The present invention relates to a waterless rinsing process of surfaces, and to an installation for implementing this process.

BACKGROUND OF THE INVENTION

For rinsing hydrophilic surfaces which have been submitted to a physical, chemical or electrochemical treatment in an aqueous medium (galvanic deposition of a coating, engraving, etching, polishing, hardening, degreasing, scouring, development and fixation, oxidation, coloration, etc.) or surfaces which have been formed in aqueous medium (by crystallization, precipitation, etc.), practically all the methods currently used on an industrial scale, use as a first step the rinsing of the articles with water, followed by the elimination of the water from said surfaces.

This type of method however presents at least two drawbacks, that is that it leads to the formation of important quantities of polluted water which are incompatible with the requirements of the protection of environment, which are becoming more and more severe, and that the aqueous solutions thus eliminated from the surfaces, even if they can be recovered, are generally degraded and unusable.

With regard to the subsequent drying process, the oldest known method consists in the free or forced evaporation of water to the atmosphere, the main drawbacks being the formation of waterspots and the oxidation of the surfaces, which is generally unacceptable. More modern methods for removing water from surfaces are based on the use of water repelling liquids. These liquids contain surface-active agents that have the effect of converting hydrophilic surfaces into water repelling surfaces that are hydrophobic. Other methods use baths such as boiling trichloroethylene or perchloroethylene added also with surface-active agents. The water is thus eliminated by formation of azeotropes, which indicates that water is rendered soluble in the solvent (7% water in the trichloroethylene-water azeotrope). and there is little or no oxidation of the surfaces, but the probleme of water spots is not resolved.

The above mentioned drawback can be partly eliminated by the use of chlorofluorinated solvents, also usable directly as cleaning, degreasing, rinsing and/or drying agents, alone or in mixture with other products such as alcohols and surface-active agents. For example, U.S. Pat. No. 3.397.150 describes means for eliminating water comprising a mixture of trichlorotrifluoroethane and a surface-active agent constituted by the neutralization product of alkylethers of phosphoric acid with an aliphatic amine, forming with water an azeotropic mixture containing about 1% water. The Figiel U.S. Pat. No. 3,710,450 teaches a method to convert hydrophilic surfaces into hydrophobic surfaces and displace water in a bath containing a chlorinated or chlorofluorinated water-immiscible solvent, with a water-miscible solvent such as isopropanol, often also added with surface-active agents such as those described in the above mentioned U.S. Pat. No. 3,397,150, and forming with water an azeotropic mixture. In addition, CH Patent 499 075, which corresponds to U.S. Pat. No. 3,386,181, proposes the use of chlorofluorinated solvents and of surface-active agents which are not able to form an azeotropic mixture with the water containing more than about 4 weight percent water. Furthermore, U.S. Pat. No. 4 169 807 describes a method of drying silicon based articles using mixtures containing propanol, water and certain perfluorinated compounds.

The main drawback of these methods, which practically always make use of a surface-active agent which decreases the surface free energy of the surface to make it hydrophobic, in addition to the drawbacks already cited relating to the use of rinsing water, consists in that the complete elimination of the surface-active agent is often difficult if not impossible in industrial conditions. The presence on the surface of an article of such a hydrophobic film, even monomolecular, of surface-active agent can be very harmful when a subsequent galvanic or other treatment is required. On the other hand, when the aqueous medium to be removed from a surface is a galvanic plating solution for example, the fact that solvents are used and that azeotropic mixtures are formed between both liquid phases imply that a liquid-liquid extraction phenomenon occurs, which is accompanied by an alteration of the plating solution so that it cannot be directly reused.

SUMMARY OF INVENTION

Consequently, the advantage of this invention is that it overcomes the drawbacks of the methods currently used for rinsing surfaces, by providing a process which does not require the use of water or surface-active agents that can leave a film that is detrimental to or otherwise impedes subsequent galvanic or other treatment.

The method according to the invention, to achieve the above purpose, is characterized in that surfaces are treated with a non-solvent and non-miscible liquid, which is thermally stable and chemically inert, in such a manner to form an emulsion with the aqueous liquid present on said surfaces, up to the complete elimination thereof, and allowing hydrophilic surfaces not to be converted into hydrophobic surfaces, and removed aqueous liquids not to be altered. In addition the surfaces can then be subjected to a further rinsing in the presence of vapors of said non-solvent and non-miscible liquid and thereafter to a drying step.

Preferably, the non-solvent liquid provided to form an emulsion with the aqueous liquid to be removed should be chosen from among the fully fluorinated organic compounds, for example the type sold under the Trade-Mark "Fluorinert" by the 3M company. In the following description, these compounds will be designated by IFL (=Inert Fluorinated Liquids). The density of IFL liquids is greater than the density of the aqueous liquids to be removed.

Another element of this invention consists of an installation for implementing the method according to the invention. This apparatus is characterized by the fact that it comprises a first rinsing zone in which means are located for treating the surfaces by an inert non-solvent liquid provided to form an emulsion with the aqueous liquid to eliminate the aqueous liquid which is on said surfaces. This apparatus can also comprise vaporization means of said inert non-solvent liquid in a second rinsing zone, and a drying zone preferably located directly above said second rinsing zone.

The installation may also comprise means for recovering the emulsion and means for breaking down said emulsion, means for separating the two formed liquid phases, as well as separate circuits for recycling the liquids thus separated.

BRIEF DESCRIPTION OF THE DRAWING

The annexed drawing illustrates schematically and by way of example one embodiment of an apparatus according to the invention for the waterless rinsing of surfaces.

DESCRIPTION OF PREFERRED EMBODIMENT

Regarding the formation of the emulsion and the breaking down and separation thereof after recovering, any known technique may be used.

For the formation of the emulsion, a receptacle containing the IFL and in which the articles are immersed can be used. These articles may be put loosly into baskets or drums, mounted on racks, or suspended in the case of articles of larger sizes, or maintained in the IFL by any kind of support; or in the case of a technique for the continuous feeding by the passage of strips, wires, films, etc.

The emulsion is created preferably through the application of ultrasonic energy, for example at frequences generally comprises between 20 and 80 kHz, or by more or less vigorous agitation and vibration of the immersed articles to be treated, either mechanically transmitted by an external source, or electro-magnetically induced within the articles, or still by agitation and vibration of the receptacle itself and transmission to the immersed articles by the liquid. These techniques and more particularly the ones using ultrasonic energy are especially appropriate for the treatment of relatively small, high-value articles, in small installations.

For articles with simple shapes, such as wires or strips, sprinkling and spraying techniques may eventually be used at more or less high pressures.

Finally, for heavy articles having relatively large sizes, treated in high-volume installations, a process of the type called "Hydroson", for example such as described in the publication "Oberfläche-Surface" No 21, 12/1980, is applicable.

As already mentioned, the inert non-solvent liquid used in the method according to the invention is preferably a fully fluorinated organic compound, for example the product called "Fluorinert" marketed by 3M. These compounds, derived from common organic compounds by replacing all the hydrogen atoms by fluorine atoms, thus containing neither hydrogen nor chlorine. These liquids are non-polar and have practically no solvent action, particularly towards water and constituents of industrial aqueous liquids such as galvanic plating solutions. The process according to the invention does not require that the aqueous liquid be at all soluble in the rinse liquid. The solubility of water in the identified IFL liquids ranges from about 15 ppm to as little as about 8 ppm. The IFL liquids are colorless, odorless, non-flammable, only slightly toxic, and of particular importance have a high thermal stability and are chemically inert. These IFL compounds are therefore, with regard to their properties, completely different from the chlorofluorinated solvents generally used as solvents, degreasing and drying agents, etc. Furthermore, the exceptional chemical inertness of IFL means that they do not convert hydrophilic surfaces into hydrophobic surfaces or contaminate or modify the emulsified aqueous solution and that this solution may thus be reused directly in the manufacturing process, after being demulsified.

Some stable fluorinated surface-active agents can be dissolved, to a certain extent, into IFL. Consequently, although it is not generally required, it may be useful in some cases to incorporate one or more of them into the IFL in order to increase the efficiency and the rapidity of the rinsing, especially when the sprinkling/spraying technique is used. The same effect may also be obtained by mixing the stable fluorinated surface-active agent with the aqueous liquid to be eliminated.

The preferred use of a fully fluorinated organic liquid does not exclude that other partly fluorinated products, for example "Freon 113", may be also used, in some cases and especially for economical reasons and/or when the qualitative requirements for the surfaces are not as high. In order to compensate for the lower emulsifying power of these partially fluorinated products, it is recommended that one or more of the above mentioned surface-active agents may be added.

With regard to the different alternatives available for breaking down an emulsion, one may cite especially the centrifugation, decantation, the action of ultrasounds at determined frequence, the chemical demulsification, the passage of the emulsion through a fine grid, a granular bed, a porous or fibrous material, hydrophobic membrane, etc. the use of a thermal effect, of ionizing radiations, of a magnetic field, the microflottation, the ultrafiltration, etc. The technique which seems to be the most appropriate is that of high tension separating or demulsifying apparatus, of the type described for example in U.S. Pat. No. 1 533 711.

Finally, with regard to the drying of the surfaces, one may cite especially the blowing of cold or warm gas, the use of infrared radiations, the free evaporation, the induction heating, the drying in vapor phase, etc. It appears however that vapor phase drying would be the most appropriate, which is well known by the men skilled in the art.

The method proposed by the present invention therefore presents, with respect to the usual methods, the following very important advantages:

no or much less pollution of the environment, particularly of effluent waters;

full recovery and in its original form of the aqueous liquids to be removed from the surfaces, and therefore of the metals or other raw materials that they contain;

hydrophilic surfaces are not converted into hydrophobic surfaces and can therefore receive subsequent galvanic or other treatments without loss of quality;

utilization of much or less space than that necessary to the clarifiers;

a very significant decrease in the consumption of water for example, the consumption of the chemicals generally used for neutralization and detoxication, the consumption of energy necessary for the evaporation of rinsing waters;

the possibility of using proven manufacturing processes, which are currently prohibited or limited due to very important detoxication problems; for example the use of compounds containing cyanides, cadmium, hexavalent chromium, etc.

Furthermore, the creation of an emulsion using a non-solvent and non-miscible liquid allows the method to be used not only for non-absorbing surfaces, but also for articles such as non-glazed ceramics, sintered articles, woven articles, etc. This method may therefore be implemented not only in the technical fields of electroplating, the manufacturing of silicon chips, printed and integrated circuits, etc. but also in photolithography, in the manufacture and the development of photographic films, in the treatment and especially the drying of textiles and in the leather, chemical, mining industries, etc.

One embodiment of the method and apparatus according to this invention will be now described by way of the example and by reference of the annexed drawing.

The articles to be rinsed (not shown) are introduced directly into a vat or receptacle 1 containing the IFL 2 at room temperature. Ultrasonic transducers 3 are put into action to enable the emulsification of the aqueous liquid with the IFL. This emulsion will tend to rise because its density is lower than that of IFL on the one part, and on the other part due to the fact that the IFL is introduced into the vat 1 through the bottom, by means of a recirculation pump 4 and through an intermediary filter 5. Consequently the emulsion 6 overflows the fat 1 and is directed towards a high tension demulsifying apparatus.

This de-emulsifying apparatus 7 comprises an axial filiform electrode 8 connected to a high tension source and a conductive cylindrical body connected to ground. The emulsion is thus broken down by the gathering of microdroplets into big drops. The mixture IFL/big drops 9 of liquid to be removed is then passed into a settler 10 or "Florentine" pot. The aqueous liquid to be removed, which is less dense than the IFL, floats to the surface and, by successive additions, overflows via the drain pipe 11. The aqueous liquid is recovered and can be reused directly as such in the manufacturing process. With regard to the IFL, it passes under the wall 10' and overflows into the tank 12 of the settler 10. This part of the tank serves as a balance for the variations in levels for the installation.

As already mentioned, the pump 4 draws the dry and clean IFL out of the tank 12 and passes it through a filter 5; it is then introduced into vat 1 through the bottom via anti-turbulence guides 13 or a porous plate, thus replacing the newly created emulsion with dry and clean IFL.

A turbidity detection device 14 determines when the emulsification process has ended, i.e. as soon as the IFL is perfectly clear. This means that the surface to be rinsed is completely free of the aqueous liquid. Another alternative for controlling the process consists of incorporating a tension detector and/or a current detector in the high tension circuit of the demulsifying apparatus, the tension being inversely proportional and the current being proportional to the quantity of microdroplets coming into the demulsifying unit.

The articles are then removed from the liquid phase rinsing zone (vat 1) and are passed into a second rinsing zone 15, which contains IFL in a vapour phase. These vapours are produced by two boilers 16 heated by heating elements 17 and fed by the tank 12. A level detection system 18 controls the valves 19.

in zone 15, containing the vapours of IFL, these vapours condense onto the articles which have been extracted from the cold IFL of the vat 1, this having as a consequence that the liquid thus distillated, extremely pure also eliminates impurities which might still be present on the surface, and that the thermal energy of the vapours is transfered to the articles, which are thus heated. Once warm, the articles may be then removed from the vapour phase zone 15 and introduced into the drying zone 20, whose walls are cooled by a double-mantle 21, in which a refrigerating fluid (water, "Freon", etc.) circulates. The cooling of the walls can also be achieved by a coil in which a refrigerating fluid circulates. Thus, the IFL present on the heated articles evaporates and recondensates on the cold walls of the double-mantle. The IFL thus recondensed flows along the walls into a settler 22 ("Florentine" pot), together with a small quantity of water which results from the humidity of the room air and being also condensed of the walls of the double-mantle, said water floating at the surface of IFL which is more dense, and by successive additions, overflows by a pipe 23 to be drained to a sewer. The IFL thus distillated is reintroduced by gravity into the bottom of the vat 1. Any impurities brought into the system are collected either in the filter 5, or in the bottom of the boilers 16. Finally, if the pump 4 stops working, a check valve 24 has been provided to prevent the IFL in vat 1 from draining back by gravity into the tank 12.

I claim:

1. A method for rinsing a surface of an object wetted by a film of an aqueous liquid in a treatment zone to produce a rinsed surface comprising:

(a) providing in a rinsing zone a liquid that is a non-solvent for and chemically inert with respect to all materials with which the liquid comes into contact and immiscible with said aqueous liquid;

(b) contacting said aqueous liquid film with said liquid at said rinsing zone with a mechanical action having sufficient intensity to cause removal of said aqueous liquid film from said wetted surface in the form of small droplets that appear in said rinsing zone liquid and form an emulsion having a dispersed phase and a continuous phase, said removed aqueous liquid being the dispersed phase and said rinsing zone liquid being the continuous phase;

(c) transporting said emulsion to an emulsion braking device to prevent said removed aqueous liquid from returning to said rinsed surface while the object surface remains wettable by said aqueous liquid;

(d) de-emulsifying said emulsion to separate said phases at said breaking device; and (e) returning said rinsing zone liquid from said breaking device to said rinsing zone.

2. The method as defined in claim 1 wherein said rinsing zone liquid consists essentially of a perfluorinated liquid that is free of hydrogen and chlorine atoms.

3. The method as defined in claim 1 wherein said rinsing zone liquid is a perfluorinated liquid that is free of a surfactant which can separate from said perfluorinated liquid during the step of contacting and emulsion formation.

4. The method as defined in claim 1 comprising the further step of collecting the separated aqueous liquid available from said breaking device for reuse in said treatment zone.

5. The method as defined in claim 4 including the further step of returning said aqueous liquid which has been collected directly to the treatment zone.

6. The method as defined in claim 1 wherein the object surface is a metallic surface which has hydrophilic properties and dragout aqueous liquid is replaced by said rinsing zone liquid, said rinsing zone liquid being at all times free of any surface-active agent the presence of which on said metallic surface would be detrimental to a subsequent galvanic treatment.

7. A method for rinsing a metallic surface which has hydrophilic properties of an object wetted by a film of an aqueous liquid in a treatment zone to produce a rinsed surface comprising:

(a) providing in a rinsing zone a liquid that is a non-solvent for and chemically inert with respect to all materials with which the liquid comes into contact and immiscible with said aqueous liquid;

(b) contacting said aqueous liquid film with said liquid at said rinsing zone with a mechanical action having sufficient intensity to cause removal of a dragout aqueous liquid film from said wetted surface in the form of small droplets that appear in said rinsing zone liquid and form an emulsion having a dispersed phase and a continuous phase, said removed aqueous liquid being the dispersed phase and said rinsing zone liquid being the continuous phase, said dragout aqueous liquid being replaced by said rinsing zone liquid;

(c) transporting said emulsion to an emulsion breaking device to prevent said removed aqueous liquid from returning to said rinsed surface while the object surface remains wettable by said aqueous liquid;

(d) de-emulsifying said emulsion to separate said phases at said breaking device;

(e) returning said rinsing zone liquid from said breaking device to said rinsing zone, said rinsing zone liquid being at all times free of any surface-active agent the presence of which on said metallic surface would be detrimental to a subsequent galvanic treatment; and wherein said rinsing zone liquid is returned to a lower bottom region of said rinsing zone through means preventing turbulent flow into said rinsing zone and the emulsion is removed from said rinsing zone at an upper overflow region of the rinsing zone, the flow of the returned rinsing zone liquid being effective to assist removal of said dragout aqueous liquid droplets in an upward direction.

8. The method as defined in claim 1 wherein the object surface is a metallic surface on a printed circuit board that has been formed as part of one of a coating process and an etching process and has hydrophilic properties and dragout aqueous liquid is replaced by said rinsing zone liquid, said rinsing zone liquid being at all times free of any surface-active agents the presence of which on said metallic surface would be detrimental to a subsequent galvanic treatment.

9. A method for rinsing a metallic surface on a printed circuit board that has been formed as part of one of a coating process and an etching process and has hydrophilic properties, said printed circuit board being wetted by a film of an aqueous liquid in a treatment zone to produce a rinsed surface comprising:

(a) providing in a rinsing zone a liquid that is a non-solvent for and chemically inert with respect to all materials with which the liquid comes into contact and immiscible with said aqueous liquid;

(b) contacting said aqueous liquid film with said liquid at said rinsing zone with a mechanical action having sufficient intensity to cause removal of a dragout aqueous liquid film from said wetted surface in the form of small droplets that appear in said rinsing zone liquid and form an emulsion having a dispersed phase and a continuous phase, said removed aqueous liquid being the dispersed phase and said rinsing zone liquid being the continuous phase, said dragout aqueous liquid being replaced by said rinsing zone liquid;

(c) transporting said emulsion to an emulsion breaking device to prevent said removed aqueous liquid from returning to said rinsed surface while the object surface remains wettable by said aqueous liquid;

(d) de-emulsifying said emulsion to separate said phases at said breaking device;

(e) returning said rinsing zone liquid from said breaking device to said rinsing zone, said rinsing zone, liquid being at all times free of any surface-active agent the presence of which on said metallic surface would be detrimental to a subsequent galvanic treatment; and wherein said rinsing zone liquid is returned to a lower bottom region of said rinsing zone through means preventing turbulent flow into said rinsing zone and the emulsion is removed from said rinsing zone at an upper overflow region of the rinsing zone, the flow of the returned rinsing liquid being effective to assist removal of said dragout aqueous liquid droplets in an upward direction.

10. A method for rinsing a surface of an object wetted by an aqueous liquid in a treatment zone comprising:

(a) providing in a rinsing zone a perfluorinated liquid that is a non-solvent for and chemically inert with respect to all materials with which the liquid compound comes into contact, and immiscible with said aqueous liquid and has a density greater than the density of said aqueous liquid;

(b) contacting said wetted surface with said perfluorinated liquid at said rinsing zone with a mechanical action having sufficient intensity to cause emulsification of said aqueous liquid in said perfluorinated liquid and form an emulsion having a dispersed phase and a continuous phase, said emulsified aqueous liquid being the dispersed phase and said perfluorinated liquid being the continuous phase; and (c) transporting said emulsion to an emulsion breaking device to prevent said removed aqueous liquid from returning to said object surface.

11. A method for rinsing a surface of an object wetted with a film of an aqueous liquid in a treatment zone to produce at a rinsing station a rinsed surface by:

forming an emulsion having a dispersed phase and a continuous phase, the aqueous liquid being the dispersed phase and a liquid at the rinsing station being the continuous phase, said rinsing station liquid having the properties of being thermally stable, a non-solvent for and immiscible with said aqueous liquid and chemically inert with respect to all materials with which the rinsing station liquid comes into contact, said emulsion being formed by a vigorous mechanical action which is effective to remove from said wetted surface substantially all the aqueous liquid of said film;

pumping new amounts of dry and clean liquid to said rinsing station at a side of said object surface so that said new amounts flow across said object surface and removing said emulsion from another side of said object surface at said rinsing station to an emulsion breaking device to prevent aqueous liquid droplets in the emulsion from returning to the object surface; and removing said rinsed object surface from said rinsing station while free of a layer that is detrimental to subsequent galvanic treatment.

12. The method of claim 11 wherein the rinsing station liquid is non-polar and has a sufficiently low solvency for said aqueous liquid that the rinsing station liquid recovered from the emulsion breaking device is reusable as said dry and clean rinsing station liquid that is supplied to said rinsing station.

13. The method of claim 11 wherein the rinsing station liquid is a perfluorinated liquid.

14. A method for removing from a surface having hydrophilic properties a film of an aqueous liquid by contacting the aqueous liquid film with a rinse liquid that is immiscible and chemically inert with said aqueous liquid and free of a surfactant with mechanical agitation having an intensity sufficient to form an emulsion between said aqueous liquid and said rinse liquid while said surface remains hydrophilic and the emulsion is removed from proximity of said hydrophilic surface.

15. A method for rinsing a hydrophilic surface wet with an aqueous liquid film, by use of a liquid that is non-miscible and chemically inert with said aqueous liquid and which does not make said surface hydrophobic comprising the steps of:

contacting said aqueous liquid film with said non-miscible liquid at a rinsing zone with a mechanical action having sufficient intensity to cause removal of said aqueous liquid film in the form of small droplets that appear in said non-miscible liquid to form an emulsion; and removing said surface from said rinsing zone while hydrophilic and essentially free of said aqueous liquid.

16. The method of claim 15 further comprising:

transporting said emulsion from said rinsing zone to an emulsion breaking device to prevent said aqueous liquid droplets from returning to said hydrophilic surface;

de-emulsifying said transported emulsion and separating said immiscible liquids;

returning said separated non-miscible liquid at said rinsing zone; and collecting said separated aqueous liquid.

17. The method of claim 15, wherein the mechanical energy is provided by ultrasonic energy.

18. The method of claim 15, wherein the mechanical energy is provided by spraying.

19. The method of claim 15, wherein the non-miscible and chemically inert liquid is a perfluorinated organic liquid.

20. The method of claim 15, wherein the non-miscible liquid is free of a surfactant that could make the rinsed surface hydrophobic.

21. The method of claim 15, wherein the non-miscible liquid is free of a surfactant which could leave on the rinsed surface a film that impedes a subsequent galvanic treatment.

* * * * *